US005743401A

United States Patent [19]

Takahashi

[11] Patent Number: 5,743,401

[45] Date of Patent: Apr. 28, 1998

[54] CONTAINER FOR ADHESIVE

[75] Inventor: Shin Takahashi, Nagoya, Japan

[73] Assignee: Toagosei Co., Ltd., Tokyo, Japan

[21] Appl. No.: 885,901

[22] Filed: Jun. 30, 1997

[30] Foreign Application Priority Data

Jul. 4, 1996 [JP] Japan ..... 8-175016

[51] Int. Cl.[6] ..... B65D 59/02; B65D 59/06

[52] U.S. Cl. ..... 206/447; 206/524.1

[58] Field of Search ..... 222/92, 95, 107; 206/447, 524.1, 813; 215/381, 202, 320, 321

[56] References Cited

U.S. PATENT DOCUMENTS 3,623,179 11/1971 Roth ..... 206/447 X 5,322,880 6/1994 Columbus et al. ..... 206/813 X

FOREIGN PATENT DOCUMENTS 6-046863 11/1994 Japan .

*Primary Examiner*—Jacob K. Ackun

*Attorney, Agent, or Firm*—Browdy and Neimark

[57] ABSTRACT

A container for adhesive, particularly α-cyanoacrylate adhesive, which has an excellent storage stability and decreases production cost due to simple assembling with the small number of parts is provided. The container for adhesive comprises a container body having a filling portion containing an adhesive and a nozzle connecting to the filling portion for pouring the adhesive, wherein a press portion having a thin wall, for sending the adhesive from the filling portion to the nozzle, is formed on the container body, and a cap having a thick wall, for covering the press portion.

4 Claims, 4 Drawing Sheets

CONTAINER FOR ADHESIVE

BACKGROUND OF THE INVENTION

The present invention relates to a container for an adhesive that can stably store α-cyanoacrylate adhesive that can instantaneously adhere a material to be adhered by pouring and application the adhesive on the material to be adhered.

PRIOR ART

A plastic-made double container comprising an inner container filled with an adhesive and an outer container having incorporated therein the inner container together with a desiccating agent is generally used as a container for α-cyanoacrylate adhesive that is known as an instantaneous adhesive, for the purpose of increasing storage stability.

However, in this double container, the inner container must be taken out from the outer container for use, and must be inserted back after use into the outer container for further storage. Thus is troublesome.

As a container that improves a complicated handling in such a double structured container, Japanese Utility Model Publication No. 6-46863 proposes a container having a structure in which an inner container filled with an adhesive is incorporated in an outer container in a fixed state, and container by press operation of a push plate provided on the outer container.

However, this container has a complicated structure for integrating the inner and outer containers into one body and also for ejecting the adhesive from the inner container by press operation of the outer container. Further, the number of parts as the container for adhesive is increased, and assembling thereof is complicated due to this increase, with a result that an increase in cost cannot be avoided.

Further, the greatest disadvantage of this container is that since the push plate is provided in appearable/diappearable in an operating window formed on the outer container, the inner container is brought into contact with an outside air through the operating window, with a result that moisture in air permeates into the inner container, so that storage stability of the adhesive remarkably deteriorates.

On the other hand, a pen-type container for adhesive, in which a needle valve is provided on a tip of a nozzle portion, is developed as another container that improves the complicated handling of the double container.

However, in this container, an adhesive is not ejected unless a tip of the pen is pushed on a material to be adhered. Therefore, the adhesive cannot be applied on the material to be adhered which is soft, and also the adhesive is applied only to a downward direction due to its mechanism. Further, the amount of the adhesive to be applied cannot be controlled, and the structure of the needle valve is complicated, resulting in increase in the cost. Thus, this container involves various practical problems.

SUMMARY OF THE INVENTION

In view of the above circumstances, a material of the present invention is to provide a container for adhesive in which an excellent storage stability can be obtained, and a material cost and assembling cost can be decreased by easy assembling of the container with small number of parts.

To attain the above materials, a container for adhesive according to the present invention comprises (A) a container body having a filling portion which contains α-cyanoacrylate adhesive and a nozzle connecting to the filling portion, for pouring the α-cyanoacrylate adhesive, the container body forming therein a thin wall portion including at least a press portion for sending the α-cyanoacrylate adhesive from the filling portion to the nozzle, and (B) a thick wall cap which covers press portion.

The container for adhesive according to the present invention is to contain α-cyanoacrylate adhesive (hereinafter referred to as an "adhesive" for simplicity). The container is constituted of a container body comprising a synthetic resin which is deactive to the adhesive, and a cap. A slim pen-type container is preferred in view of use.

The container body constituting a container for adhesive is basically formed by a cylindrical filling portion for storing the adhesive and a tapered nozzle for application the adhesive stored in the filling portion on a material to be adhered. The adhesive is introduced from an inlet for filling the adhesive formed on a base end side of the filling portion, and the inlet for filling the adhesive is sealed with a sealing member.

The shape of the filling portion is preferably a cylindrical shape in view of molding, but may be an elliptically cylindrical shape or a square cylindrical shape.

The nozzle may have a thin wall or a thick wall because it is completely covered with the thick-wall cap. The shape of the nozzle may be a pyramid shape besides a conical shape.

The sealing member preferably has such a structure that it cannot easily be detached from the container body after fixing thereto.

A thin wall press portion for sending the adhesive contained in the filling portion to the nozzle side is formed on the container body.

This press portion may be formed such that, for example, the filling portion including the inlet for filling the adhesive is constituted to have a thick wall and further in the case that a neck portion having a diameter smaller than that of the filling portion provided in connection with the filling portion and the nozzle are integrally provided, a part or the whole of the neck portion may be molded to have a thin wall.

In the case that the filling portion including the inlet for filling the adhesive is constituted to have a thick wall and the nozzle is provided in such a manner as to connect to the filling portion, a part of the filling portion having a thick wall is molded to have a thin wall.

In either case, the container body except for at least the nozzle for applying the adhesive and the press portion is molded to have a thick wall so as not to permeate moisture therein.

A part or the whole of the container body may be semi-transparent such that the amount of the adhesive remained in the container body can be visually observed.

The cap covered on the container body preferably has a wall thickness more than that of the thick wall portion of the container body, and also has a length sufficient to cover at least a thin wall nozzle and a press portion, formed on the container body.

In other words, it is preferred for the cap to cover most of the filling portion of the container body which contains the adhesive. However, it is sufficient if the cap can sufficiently cover the press portion having a thin wall formed on the container body.

The container body and the cap are integrally molded with a plastic material such as polyethylene or polypropylene, which is deactive to the adhesive. A material such as polyester, polyamide, polyvinyl chloride or polybutadiene can also be selectively used as the material the cap. The container body and the cap are obtained by injection molding or blow molding.

A cylindrical wall having a low height is preferably formed around the base end portion of the nozzle in the container body to form a liquid reservoir comprising a circular recess portion between the wall and the base end portion. As a result, the adhesive flown down along the top outer periphery of the nozzle is received by this liquid reservoir. It preferably has a structure which can prevent that the adhesive is polymerized and the cap cannot be detached from the container body.

The tip of the nozzle may be molded in the sealed state. When the cap is deeply covered on the container body as in the normal state, a needle member formed on an inner surface of a canopy of the cap sticks the sealed portion of the nozzle to form a hole on the sealed portion, and simultaneously the adhesive in the filling portion can be prevented from leakage in the state that the needle member is stuck in the nozzle.

Further, the nozzle may be a so-called twisting off type in which the nozzle is molded so as to have a knob on its tip, and the nozzle is opened by twisting off the knob. In this case, after the knob is twisted off, the nozzle-opened portion may be sealed with a needle member which is separately attached. In this embodiment, it is not necessary to provide a needle member on the inner surface of the canopy of the cap.

The cap may be fitted on the container body by screwing female and male screws formed on the inner side of the open portion of the cap and the outer periphery of the container body, respectively.

Further, the cap may be fitted on the container body by fitting a convex portion and a concave groove formed on the cap and the container body, respectively. In summary, the structure is sufficient if the cap and the container body are air-tightly fitted, and the cap is not accidentally detached from the container body.

Since the container for adhesive according to the present invention comprises the container body in which at least the press portion for sending the adhesive from the filling portion to the nozzle is formed in such a manner as to have a thin wall, and the cap having a thick wall for covering the press portion, the thin wall portion of the container body is covered with the thick wall cap so that this portion substantially constitutes a double container, thereby securing moisture proof property and the thick wall filling portion which is not covered with the cap certainly shields moisture in air by its thick wall, thereby increasing the wholly moisture proof property. Accordingly, the storage stability of the adhesive contained in the container can be improved over a long period of time.

DESCRIPTION OF THE PREFERRED EMBODIMENT

Figure 1:
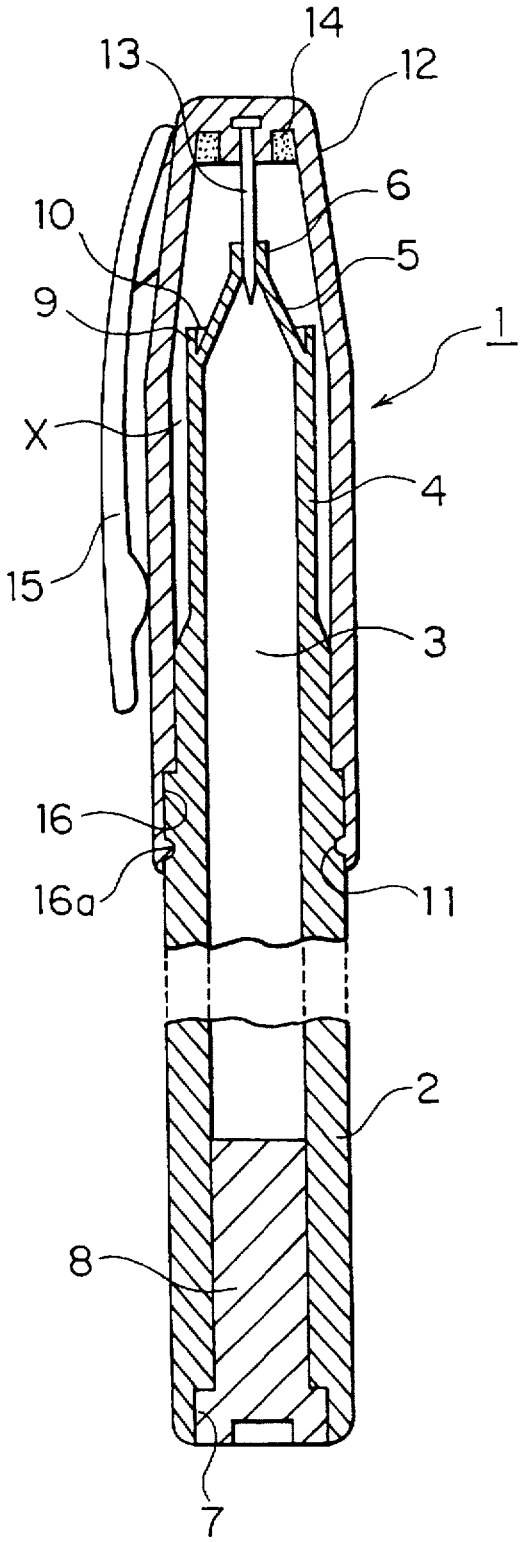
FIG. 1 is a vertically cross sectional view showing one example of the container for adhesive according to the present invention.

An embodiment of a container if or adhesive according to the present invention is explained below in more detail with reference to the accompanying drawings.

The container 1 for adhesive according to the present invention comprises a container body 2 having a filling portion 3 containing an adhesive and a tapered nozzle for pouring the adhesive contained in the filling portion 3 and application the same on a material to be adhered, and a cap 12 that covers the nozzle of the container body 2 and also covers the predetermined peripheral portion of the filling portion 3 connecting to the nozzle.

The container body 2 is a cylindrical member obtained by injection molding of a plastic material (polyethylene in the embodiment) which is deactive to the adhesive. The cylindrical wall of the filling portion 3 including an inlet 7 for filling the adhesive is molded to have a thick wall. Simultaneously, a thin wall and short cylindrical neck portion 4 having a diameter smaller than that of the filling portion 3 and a base end portion 5 of a cylindrical nozzle (hereinafter referred to as "nozzle base end") formed by gradually decreasing the diameter of the tip end potion of the neck portion 4 are continuously provided on the tip end portion of the filling portion 3 via a step portion. A thin wall and conical nozzle tip end portion 6 (hereinafter referred to as "nozzle tip end") are integrally formed on the tip end portion of the nozzle base end 5. The tip of the nozzle tip end 6 is sealed during molding.

The nozzle tip end 6 is semi-transparent so that the adhesive in the inside can be visually observed.

The entire length of the container body 2 is a length such that when the neck portion 4 is held with thumb and forefinger, the tip end or its vicinity of the thick wall filling portion 3 contacts with a root portion of thumb and forefinger so that the adhesive can stably be poured. More specifically, the container body is a pen-type having a length of 100 to 150 mm, similar to the length of a ball-point pen or the like. The diameter of the container body is also almost the same as in the diameter of a ball-point pen.

The adhesive is introduced at a predetermined amount from the inlet 7 for filling the adhesive in the container body 2. Then a sealing member 8 penetrating a fine hole (not shown) for discharging air is inserted into the inlet 7 for filling the adhesive, and is strongly fixed in such a manner that the sealing member 8 is not accidentally detached. Thereafter, the fine hole is sealed with ultrasonic wave sealing to completely clog the inlet 7 for filling the adhesive.

It should be noted that the sealing member 8 is also molded using a synthetic resin which is deactive to the adhesive to be filled.

In such a container body 2, excluding the thin wall nozzle tip end 6 and the thin wall nozzle base end 5 connecting to the nozzle tip end 6, the neck portion 4 and the filling portion 3 substantially constitute a portion containing the adhesive.

The wall thickness of the filling portion 3 in the container body 2 is a thickness to such an extent to avoid that at least moisture in outside air permeates into the filling portion 3 so as to deteriorate the adhesive. The wall thickness of the filling portion 3 is preferably about 1 to 6mm.

On the other hand, the neck portion 4 may have a wall thickness to such an extent that the inside adhesive can easily be poured through the nozzle tip end 6 by pressing the neck portion 4 with fingers from the outside and the neck portion 4 is returned to the original shape when the pressing is stopped. A press portion having a thin wall may be formed on a part of the neck portion 4, facilitating to pour the adhesive, and the other portion thereof may have a relatively thick wall so as to prevent permeation of moisture in air as much as possible. The wall thickness of the press portion is preferably about 0.1 to 1.5mm.

Incidentally, a cylindrical wall 9 having a small height is formed integrally on the outer periphery of the connecting portion of the nozzle base end 5 and the nozzle tip end 6. A circular concave portion is formed between the cylindrical wall 9 and the outer peripheral surface of the nozzle tip end 6 to constitute a liquid reservoir 10. The adhesive flown down along the outer periphery of the nozzle tip end 6 at a time of pouring the adhesive is received with this liquid reservoir 10 so as to prevent that the fitted cap 12 cannot be separated from the container body by polymerization of the adhesive.

Even if the adhesive flown over from the liquid reservoir 10 is flown out along the outer periphery of the nozzle base end 5, a space X is formed between the inner surface of the cap 12 and the nozzle base end 5, so that adhesion of the cap 12 can be prevented due to this space X.

On the other hand, the cap 12 is provided with a clip 15 on its outside, and has a length which can sufficiently cover a portion from the nozzle tip end 6 of the container body 2 to the upper end portion of the filling portion 3, including the thin wall neck portion 4.

At the center of the inner surface of the canopy inside the cap 12, a needle-like sealing member 13 is provided, which can stick the tip point of the nozzle tip end 6 obtained in the closed state to perforate the nozzle tip end, and can shield leakage of the inside adhesive by inserting the same into the perforated portion of the nozzle 6 after perforation. A solid desiccating agent 14 is fixed onto the outer periphery of the sealing member 13.

Further, an inner surface 16 having a step portion of an increased diameter, on which the filling portion 3 of the container body 2 is contact fitted, is formed on the inner surface of the open portion of the cap 12, and a convex portion **16*a* fitting to the concave groove 11 formed on the outer periphery of the filling portion 3 of the container body 2 is provided under the inner surface 16** having an increased diameter.

The cap 12 can easily be obtained by an injection molding of polyethylene similar to the container body 2, particularly by an insert injection molding in which the base end of the needle-like sealing member 13 is inserted.

Further, the wall thickness of the cap 12 can be freely selected from the thickness to such an extent that permeation of the moisture in air can be prevented.

Figure 2:
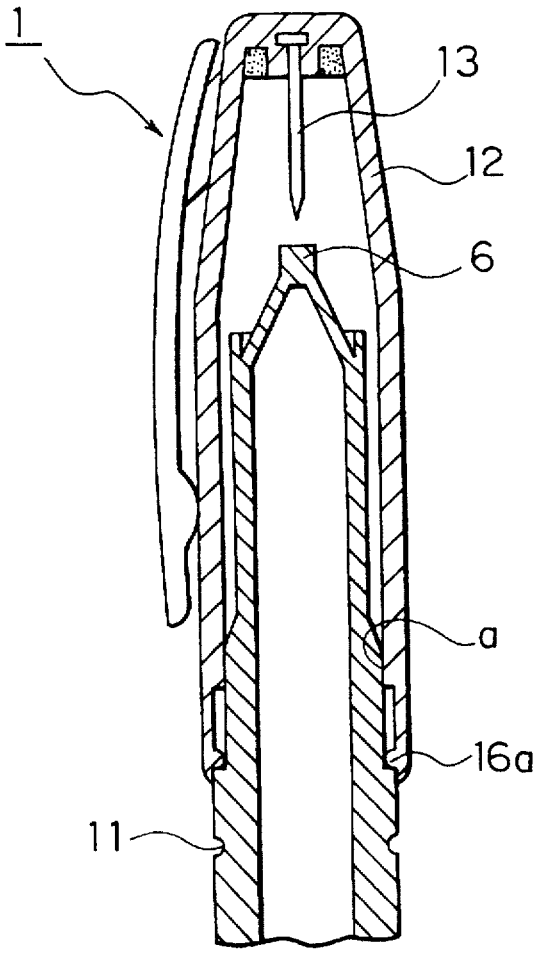
FIG. 2 is an enlarged cross sectional view showing one example of the state that the tip of nozzle is not opened.

The nozzle tip end 6 of the container body 2 is molded in the closed state as shown in FIG. 2. The adhesive is filled into the container body 2 from the inlet 7 for filling the adhesive. The inlet for filling the adhesive is sealed with the sealing member 8, to store and maintain the adhesive in the container body.

In this case, the cap 12 is lifted upward the container body 2, and the convex portion **16*a* formed on the inner surface in the vicinity of the opening portion is obstructed by the step portion formed on the connecting portion of the filling portion 3 of the container body 2 and the neck portion 4**, so that the cap covers the nozzle slightly. The container is packaged in such a manner that the cap does not cover the nozzle deeply any more, and is offered for sale.

In this state, the sealing member 13 is positioned on the upper portion of the closed nozzle tip end 6 while securing the state that the sealing member does not stick the tip face of the nozzle tip end 6. Simultaneously the inner surface of the cap 12 and the outer periphery of the filling portion 3 of the container body 2 are brought into contact at a contact portion a to shield the thin wall portion of the container body 2 from the outside, thereby securing moisture proof property.

Figure 3:
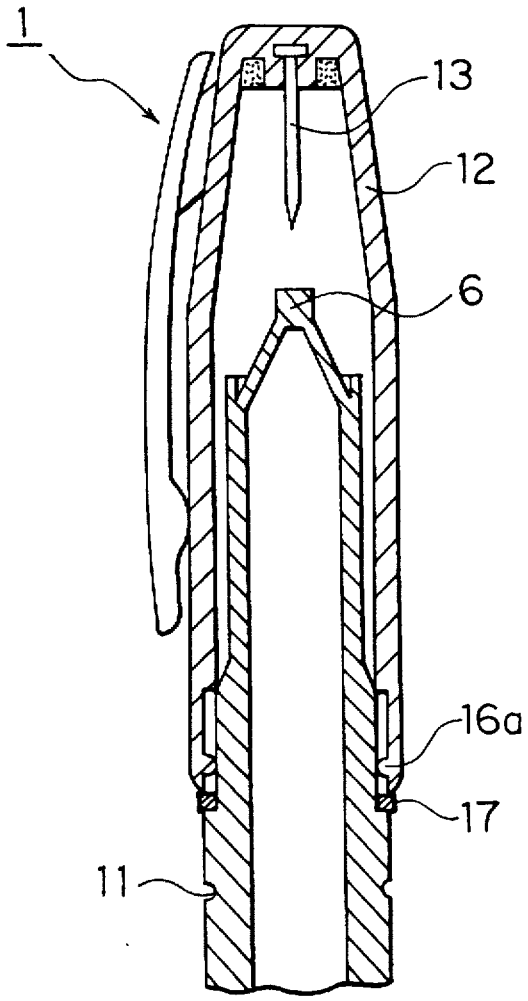
FIG. 3 is an enlarged cross sectional view showing another example of the state that the tip of nozzle is not opened.

FIG. 3 shows other embodiment in which the cap slightly covers the nozzle in the state that the nozzle is not stuck. A stopper 17 which can easily be removed by breakage is formed at the step portion of the filling portion 3 of the container body 2 and the neck portion 4, so that the cap 12 can slightly cover the nozzle similar to the embodiment shown in FIG. 2.

Accordingly, in opening the nozzle tip end 6, the embodiment shown in FIG. 2 is constituted such that the cap 12 is simply pushed down, and the embodiment shown in FIG. 3 is constituted such that the stopper 17 is removed and the cap 12 is then pushed down, so that the convex portion **16*a* is fitted to the concave groove 11 formed on the filling portion 3 of the container body 2, and the tip of the sealing member 13 sticks the nozzle tip end 6** to shield leakage of the adhesive.

In this state, the cap 12 covers a thin wall portion including the nozzle tip end 6 of the container body 2 to prevent permeation of moisture, and the portion of the filling portion 3 of the container body 2 which is not covered with the cap 12 is prevented from permeation of moisture due to the thick wall. As a result, the container as a whole secures moisture proof property, thereby making the usable state as shown in FIG. 1.

In actual use, since the cap 12 is lifted upward to be removed from the container body 2, whereby the sealing member 13 is pulled out from the nozzle tip end 6, by holding the thin wall neck portion 4 with fingers and pressing the portion, the adhesive can be poured from the nozzle tip end 6 to apply on a material to be adhered.

Figure 4:
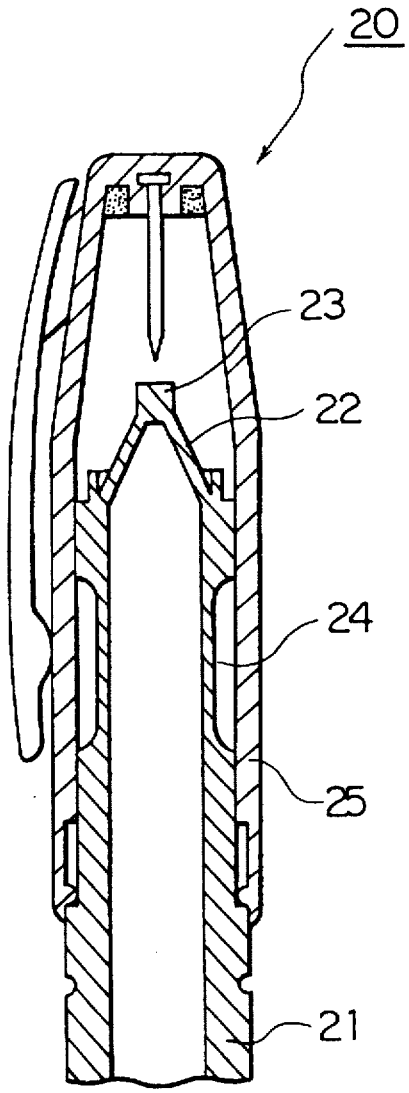
FIG. 4 is a cross sectional view of main portions showing another example of the container for adhesive according to the present invention.

FIG. 4 shows other embodiment of the container for adhesive according to the present invention. The entire body including the inlet for filling the adhesive (not shown) is molded with polypropylene into a thick wall cylindrical shape to form the container body 21. Simultaneously a thin wall nozzle tip end 23 is integrally formed on a tip end of the container body 21 through a thin wall and conical nozzle base end 22. Further simultaneously a part of an outer periphery of a tip end of the thick wall container body 21 is molded to have a thin wall so as to form a press portion 24. A container 20 for adhesive is structured such that a cap 25 covers the press portion 24 of the thin wall of the container body 22.

Therefore, upon use, the cap 25 is removed from the container body 21, and the thin wall press portion 24 is pressed by fingers, whereby the adhesive can simply and easily be poured from the container body.

The container for adhesive according to the present invention is constituted such that the filling portion containing a-cyanoacrylate adhesive is formed to have a thick wall and at least the press portion for sending the α-cyanoacrylate adhesive to the nozzle is formed to have thin wall so as to form the container body, and the thin wall portion of the container body is covered with the thick wall cap. Therefore, in the state that the container body is covered with the cap, the thin wall portion of the container body is covered with the cap to substantially form a structure of a double container, thereby maintaining the moisture proof property. The thick wall portion not covered with the cap surely shields permeation of moisture from the outside due to its thick wall itself, and moisture proof property is surely increased as a whole. As a result, it is possible to secure the storage stability of the inside adhesive over a long period of time.

Further, upon using the adhesive, the adhesive can be poured from the nozzle by only removing the cap, which is easy to handle.

Furthermore, a combination of the container body and the cap provides a partial double structure, and the other portion has a single structure having a moisture proof property, so that the container for adhesives can be produced with the small number of parts. Therefore, material cost, package cost (e.g., assembling cost), and the like can be greatly decreased.

What is claimed is:

1. A container for adhesive comprising:

a container body having a filling portion which contains α-cyanoacrylate adhesive and a nozzle connecting to the filling portion for pouring the α-cyanoacrylate adhesive; and a cap for covering at least said nozzle, wherein a press portion for sending the α-cyanoacrylate adhesive from said filling portion to the nozzle is formed on said filling portion and having a thick wall thinner than the other portion of said filling portion, and said cap covers said press portion and has a thick wall.

2. The container for adhesive as claimed in claim 1, wherein said container body is provided with a neck portion of the filling portion having a diameter smaller than that of the filling portion between said filling portion and said nozzle, and a part or the whole of said neck portion constitutes the thin press portion.

3. The container for adhesive as claimed in claim 2, wherein said cap is provided with a needle-like member, and when said cap covers the nozzle, said needle-like member sticks the nozzle to close an opening of the nozzle.

4. The container for adhesive as claimed in claim 1, wherein said cap is provided with a needle-like member, and when said cap covers the nozzle, said needle-like member sticks the nozzle to close an opening of the nozzle.

* * * * *